US006131952A

United States Patent [19]

Blau et al.

[11] Patent Number: 6,131,952

[45] Date of Patent: Oct. 17, 2000

[54] CLOTH BOOK WITH RIGID SUPPORT

[76] Inventors: Dan Blau, 2584 Joshua La., Northbrook, Ill. 60062; Vic Cavallaro, 67 Old Chimney Rd., Upper Saddle River, N.J. 07458; Kevin Murphy, 2 Minuteman La., Wellesley, Mass. 02181

[21] Appl. No.: 09/503,571

[22] Filed: Feb. 14, 2000

[51] Int. Cl.[7] ..... B42D 3/00

[52] U.S. Cl. ..... 281/33; 281/37

[58] Field of Search ..... 281/29, 33, 36, 281/37, 51; 402/70, 73, 4

[56] References Cited

U.S. PATENT DOCUMENTS

| | | | |
|---|---|---|---|
| 1,957,039 | 5/1934 | Buergen et al. | 281/33 |
| 2,190,090 | 2/1940 | Tharp | 281/33 |
| 2,947,552 | 8/1960 | Denerski | 281/33 |
| 3,210,094 | 10/1965 | Sloves . | |

*Primary Examiner*—Willmon Fridie, Jr.

*Attorney, Agent, or Firm*—Marshall, O'Toole, Gerstein, Murray & Borun

[57] ABSTRACT

A self-supporting book having a resilient support member which is nested within the book when it is closed. Opening the book causes the support element to project outwardly from the bottom of the book, forming a base for holding the book upright, in a vertical position.

8 Claims, 3 Drawing Sheets

CLOTH BOOK WITH RIGID SUPPORT

FIELD OF THE INVENTION

The present invention relates to a cloth-covered book which incorporates a collapsible support member which permits the book to remain upright when it is opened. The structure is particularly useful for books directed to pre-school children.

BACKGROUND OF THE INVENTION

Most early childhood educators agree that it is desirable to develop a positive attitude toward books in pre-school children. In addition to two-dimensional visual effects, such as bright colors, this is generally accomplished by incorporating eye-catching or entertainment features into the pages of children's books—in particular, three-dimensional objects which can be moved about the surface of the page, or "pop-up" features which rise out of the book when a page is turned or some other action taken. The consensus is that making the book more three-dimensional will hold the interest of the child over a longer period of time.

One means of accomplishing this end is to make the book, itself, a three dimensional object. An example of such an approach is shown in U.S. Pat. 5,967,874, which provides a children's book having a rigid support which is designed to hold the book in an upright position when the book is opened. The rigid support comprises an interior page of the book which is substantially thicker than the other pages of the book.

SUMMARY OF THE INVENTION

The book of the present invention is also designed to remain upright when the pages of the book is opened. This is accomplished by providing outer pages comprising a front book cover and a back book cover, each covered with a cloth-like material. Underneath the outer cloth surface is a thicker, reinforcing layer, typically formed of a flexible polyurethane foam, although other materials could also be used. This construction adds rigidity to the book, and also gives the covers a three-dimensional property. The cloth cover, generally sewed around the reinforcing core, typically has pictures and/or other indicia on the surface.

The other essential element of the three-dimensional book of the present invention is a collapsible support which is affixed along the base of the book's front and back covers, or affixed to the base of first and last pages members of the book (i.e., the pages immediately adjacent to the book's front and back covers; in a twelve-page book, these first and last page members would be numbered "1–2" and "11–12," respectively). The cover and first and last page members are referred to herein as "outermost page elements." The collapsible support is adapted to be nested within the book in the closed position. When the book is opened, however, the support is designed to project outwardly (i.e., in a plane perpendicular to the spine of the book), serving as a support to hold the book in an upright position.

At least the core of the collapsible support should be formed of a deformable material which can be folded to a stored position when the book is in the closed position. While it should be capable of being easily folded, the core material must have sufficient elastic memory to be able to spring open when the book is opened. Although a person of ordinary skill in this field will envision a number of materials which can be used for this purpose, a polyurethane foam material (preferably cloth covered) is especially suitable.

In addition to front and back covers, and a collapsible support, the cloth book of the present invention will also have one or more interior pages. It is contemplated that in addition to pictures and other brightly colored indicia (which can be silk-screened onto the surface in the case of cloth) each of these interior pages can have movable objects attached thereto. Examples include: zippers; a button and a button hole; tethered objects which can be moved around on a page by means of Velcro attachments; and the like. The goal is to provide a pre-school child with the opportunity to work with three-dimensional objects, an important element of early childhood education.

The interior pages of the book can be manufactured of composites, laminates, plastics, paper or pulp-based materials. However, in a preferred embodiment the interior pages will have the same construction as the cover— a cloth surface surrounding a core of soft material.

BRIEF DESCRIPTION OF THE FIGURES

The invention will be better understood by reference to the accompanying drawings, wherein.

DETAILED DESCRIPTION OF THE PREFERRED EMBODIMENT

Figure 1:
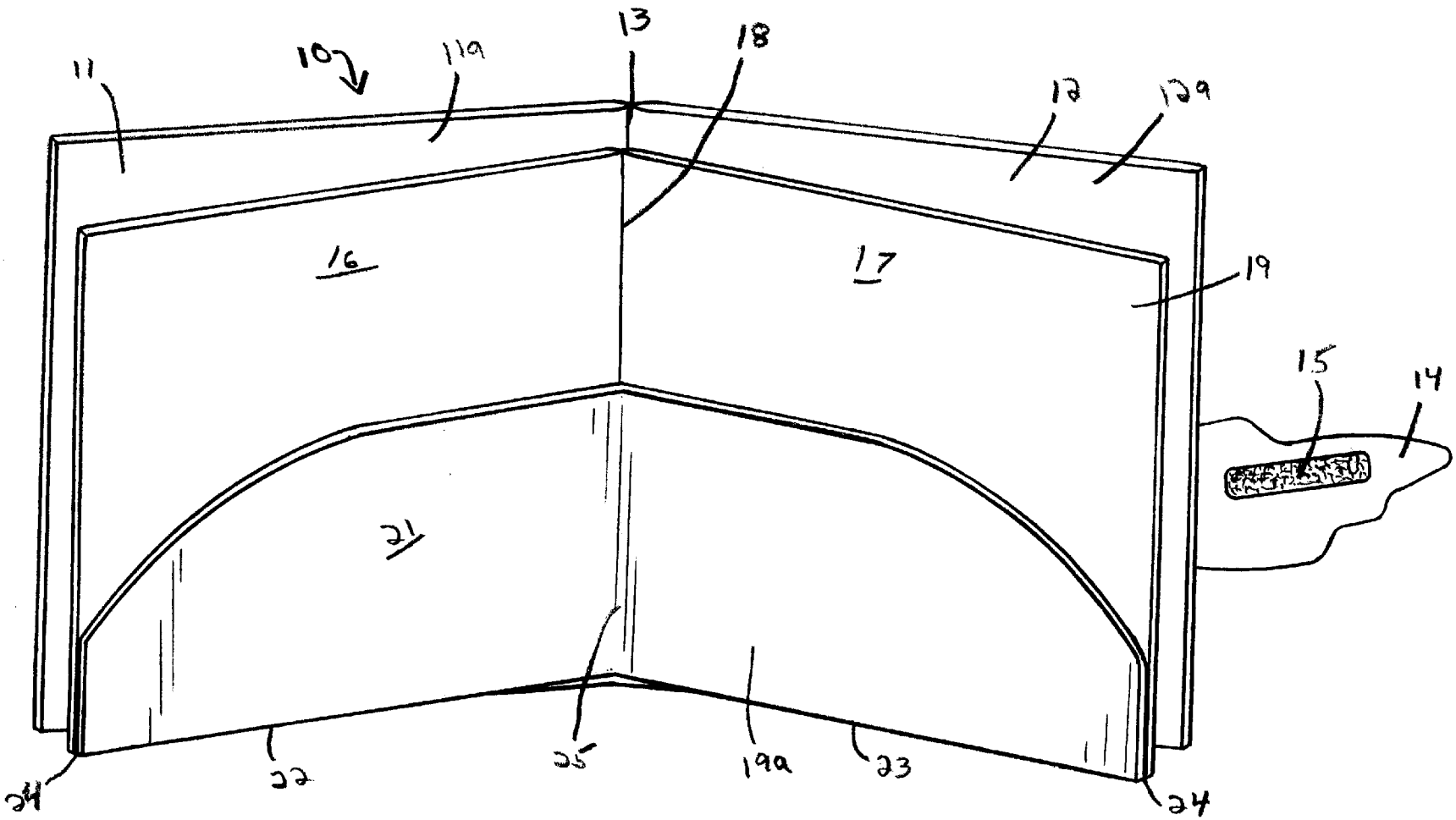
FIG. 1 is a perspective view of the book of the present invention, showing the book in the partially-opened position.
Figure 2:
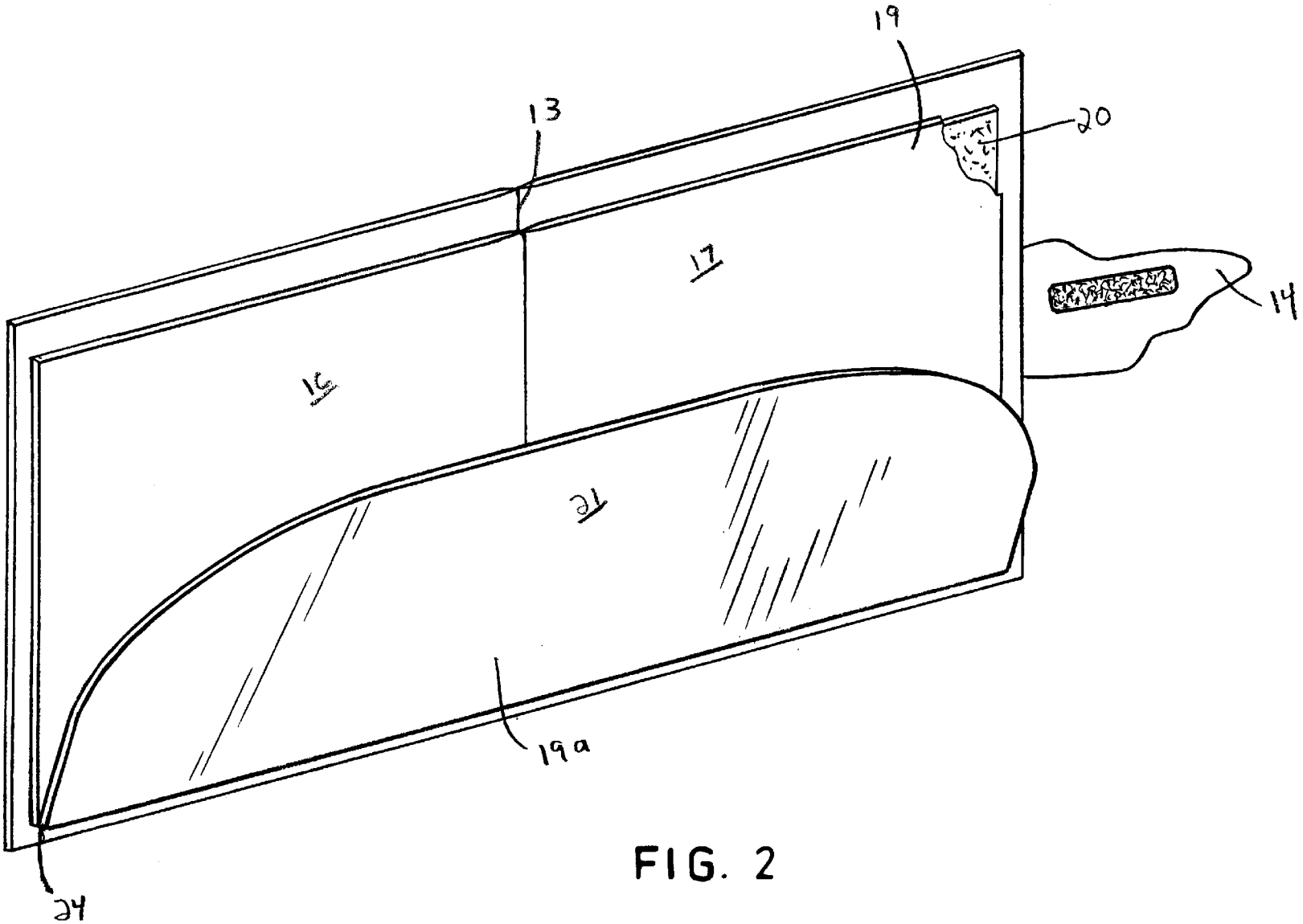
FIG. 2 is a perspective view showing the book in the fully-opened position, with the collapsible support in the process of moving to the extended position.
Figure 3:
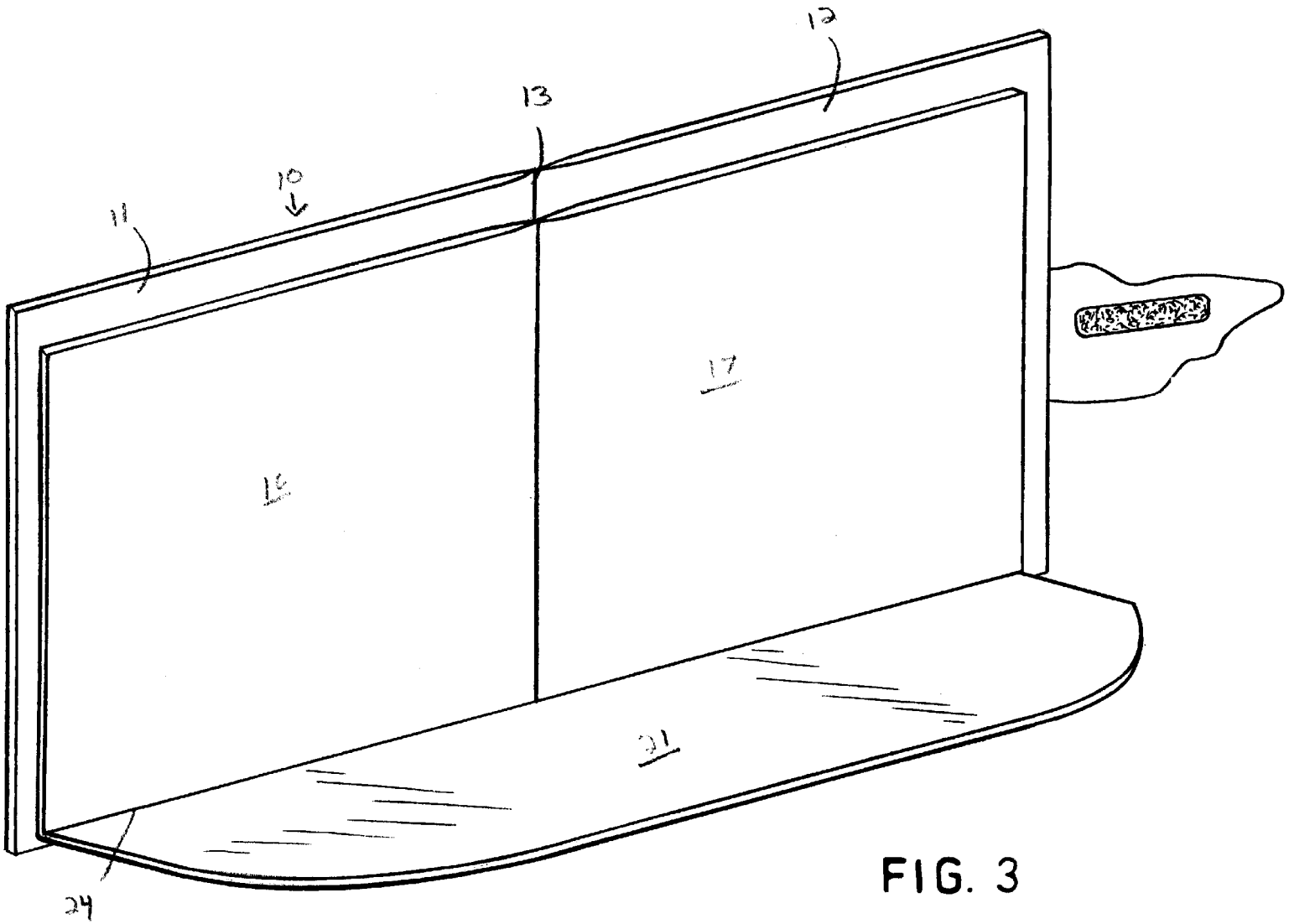
FIG. 3 is a perspective view showing the book in the open position, with the collapsible support in the fully-extended position.

One embodiment of the present invention is disclosed in FIGS. 1–3, which show a cloth-covered book 10 in three open stages.

FIG. 1 shows book 10 in the partially-opened position. Book 10 has front and back outer pages or covers 11, 12 respectively, the inside surfaces of which can be seen in the drawing. Covers 11, 12 meet at a pivot line 13 which forms the spine of the book. Covers 11 and 12 have outer cloth surfaces 11*a*, 12*a*, which cover an interior reinforcing layer or core (not shown) which is formed of a soft material. A decorative fastener member 14, attached to back cover 12, has a velcro patch 15 which is adapted to mate with a complementary velcro fastening surface (not shown) on the front surface of cover 11. The core of covers 11, 12 can be formed of a single sheet of material, covered front and back, with a cloth-like material, and the spine 13 formed by heating. Alternatively, covers 11, 12 can be separately formed and stitched together to form spine 13.

Within covers 11, 12 of book 10 are first and last page elements 16, 17 which are joined to one another and to book spine 13 at fold 18 (Covers 11, 12 and pages elements 16, 17 comprise the "outermost pages" of book 10). Page elements 16, 17 have a smaller surface area than covers 11, 12. As is the case with the covers, page elements 16, 17 have a cloth covering 19 surrounding a resilient core 20 (FIG. 2). The front and back surfaces of page elements 16, 17 will normally have drawings and other indicia (not shown).

An arcuate, collapsible support element 21 is secured to base sections 22, 23 of page elements 16, 17 along a continuous hinge 24. In a preferred embodiment, collapsible support element will be a continuation of page element 16, 17—i.e., a unitary resilient core 20 (FIG. 2) having a cloth covering 19*a*. Hinge 24 can be formed by application of a heat and pressure (e.g., a heated mandrel) to base sections 22, 23 of page elements 16, 17. Support element 21 is adapted to be nested within book 10 when it is in a closed position, at which point element 21 is folded horizontally upward along hinge 24, and folded vertically along crease 25, adjacent book spine 13. In this condition, support element 21 has the characteristics of a compressed spring, requiring a closure element such as fastener member 14 to hold the book in a closed position.

Operation of support element 21 can be best understood by reference to FIGS. 1–3. FIG. 1 shows book 10 in a partially-opened position; at this point, support element 21 is in the nested position. FIG. 2 shows book 10 as it reaches the fully-opened position. At this point, the stresses in resilient core 20 along vertical crease 25 and horizontal hinge 24 are relieved, and support element 21 moves outwardly from page elements 16, 17, until it reaches the fully-opened position shown in FIG. 3. In FIG. 3, collapsible support element 21 is in the fully-extended position; that is, support element 21 is in a horizontal plane which is perpendicular to book spine 13, allowing the book to be held upright on a table, shelf or other horizontal surface.

To close the book, one reverses the above procedure. Support element 21 is folded upward, along horizontal hinge 18, to the closed position of FIG. 1. Front and back covers 11, 12 are then closed, and fastener member 14 is secured to hold the book in the closed position.

Further alternatives and other embodiments of the invention will be apparent to those having skill in the art; accordingly, reference should be made to the following claims as indicating he scope of the present invention.

What is claimed is:

1. A self-supporting book comprising a plurality of page elements joined at a spine, said book comprising:

a fastener member for holding the book in a closed position;

at least one pair of outermost page elements comprising a resilient core having a cloth-like covering;

a resilient collapsible support mounted to the bottom of one pair of said resilient page elements along a continuous horizontal hinge;

said collapsible support adapted to extend outwardly and in a plane which is perpendicular to the spine of said book when the book is in an open position; and said collapsible support adapted to be folded upward along said continuous horizontal hinge, and nested within the book when the book is in the closed position.

2. The self-supporting book of claim 1 wherein said outermost page elements comprise the book front cover and the book back cover.

3. The self-supporting book of claim 1 wherein said outermost page elements comprise first and last page members.

4. The self-supporting book of claim 1 wherein the resilient core comprises a polyurethane foam.

5. The self-supporting book of claim 1 wherein the core of said collapsible support is integral with the core of said pair of outermost page elements, and said continuous horizontal hinge is formed by application of heat and pressure to the resilient core.

6. The self-supporting book of claim 1 wherein all of the page elements comprise a resilient core having a cloth covering.

7. Apparatus according to claim 1 comprising a cloth-covered children's book.

8. Apparatus according to claim 1 wherein said faster member comprises complementary velcro fastening elements, one said fastening element mounted on an articulated member whose base is secured to a back cover of the book, and the second fastening element secured to a front cover of the book.

* * * * *